US006732756B2

(12) United States Patent
Brod et al.

(10) Patent No.: US 6,732,756 B2
(45) Date of Patent: May 11, 2004

(54) ADAPTER FOR VALVE AND MANIFOLD ASSEMBLY

(76) Inventors: Carl R. Brod, 1426 Paseo Manzana, San Dimas, CA (US) 91773; David M. Sherwin, 10323 Sylvia Ave., Northridge, CA (US) 91324

( * ) Notice: Subject to any disclaimer, the term of this patent is extended or adjusted under 35 U.S.C. 154(b) by 0 days.

(21) Appl. No.: 09/905,476

(22) Filed: Jul. 16, 2001

(65) Prior Publication Data

US 2003/0010389 A1 Jan. 16, 2003

(51) Int. Cl.[7] ..... E03B 3/00
(52) U.S. Cl. ..... 137/269; 137/454.5
(58) Field of Search ..... 137/625.31, 269, 137/454.5

(56) References Cited

U.S. PATENT DOCUMENTS 3,082,786 A * 3/1963 McLean ..... 137/454.5
4,256,163 A * 3/1981 Orszullok ..... 137/625.31
4,314,581 A * 2/1982 Schrock ..... 137/454.5
4,616,677 A 10/1986 Krechel et al.
4,678,002 A * 7/1987 Valley ..... 137/625.31
4,699,170 A * 10/1987 Diephuis et al. ..... 137/454.5
4,738,277 A * 4/1988 Thomas ..... 137/454.5
4,821,765 A * 4/1989 Iqbal et al. ..... 137/270
4,901,755 A * 2/1990 Rodstein et al. ..... 137/454.5
4,941,507 A * 7/1990 Shenn ..... 137/625.37
4,966,186 A * 10/1990 Rodstein ..... 137/454.5
5,996,614 A * 12/1999 Ashton ..... 137/454.6
6,047,734 A * 4/2000 Robinson ..... 137/625.37

* cited by examiner

*Primary Examiner*—John Fox
(74) *Attorney, Agent, or Firm*—Eric K. Satermo

(57) ABSTRACT

An adapter for disposing between a replacement valve and a manifold to provide an improved valve.

18 Claims, 2 Drawing Sheets

2
15
21
6
4
10
22
34
16
38
26
24
25
35
32
12
30
33
36
14
37
18
20
43
41

ADAPTER FOR VALVE AND MANIFOLD ASSEMBLY

BACKGROUND AND SUMMARY OF THE INVENTION

The present invention provides an adapter for mounting between a valve cartridge and an existing water manifold, typically an older and existing manifold. A prior valve is typically replaced with a later type valve adapted to effect opening and closing of the valve with a partial turn of a knob or the like. A typical application for the invention is the replacement of a shower valve having operating valve handles and a compression seal. Over a substantial period of service, such prior art arrangements develop compressed seals, loose packing, etc. with resultant valve leakage. Replacement parts are often not available for components of old valve and mounting parts.

The adapter of the invention is threadedly mounted in an opening in a manifold, and a cartridge valve with an operating knob is threadedly secured in the adapter. An externally threaded portion of the adapter has a passage communicating with the manifold. The adapter has a sealing portion having a passage communicating with the manifold, and has a resilient seal for sealing engagement with a seat on the water manifold. The adapter is typically utilized with a valve cartridge device.

DESCRIPTION OF PREFERRED EMBODIMENTS

Figures 1, 2, 2A, 3:
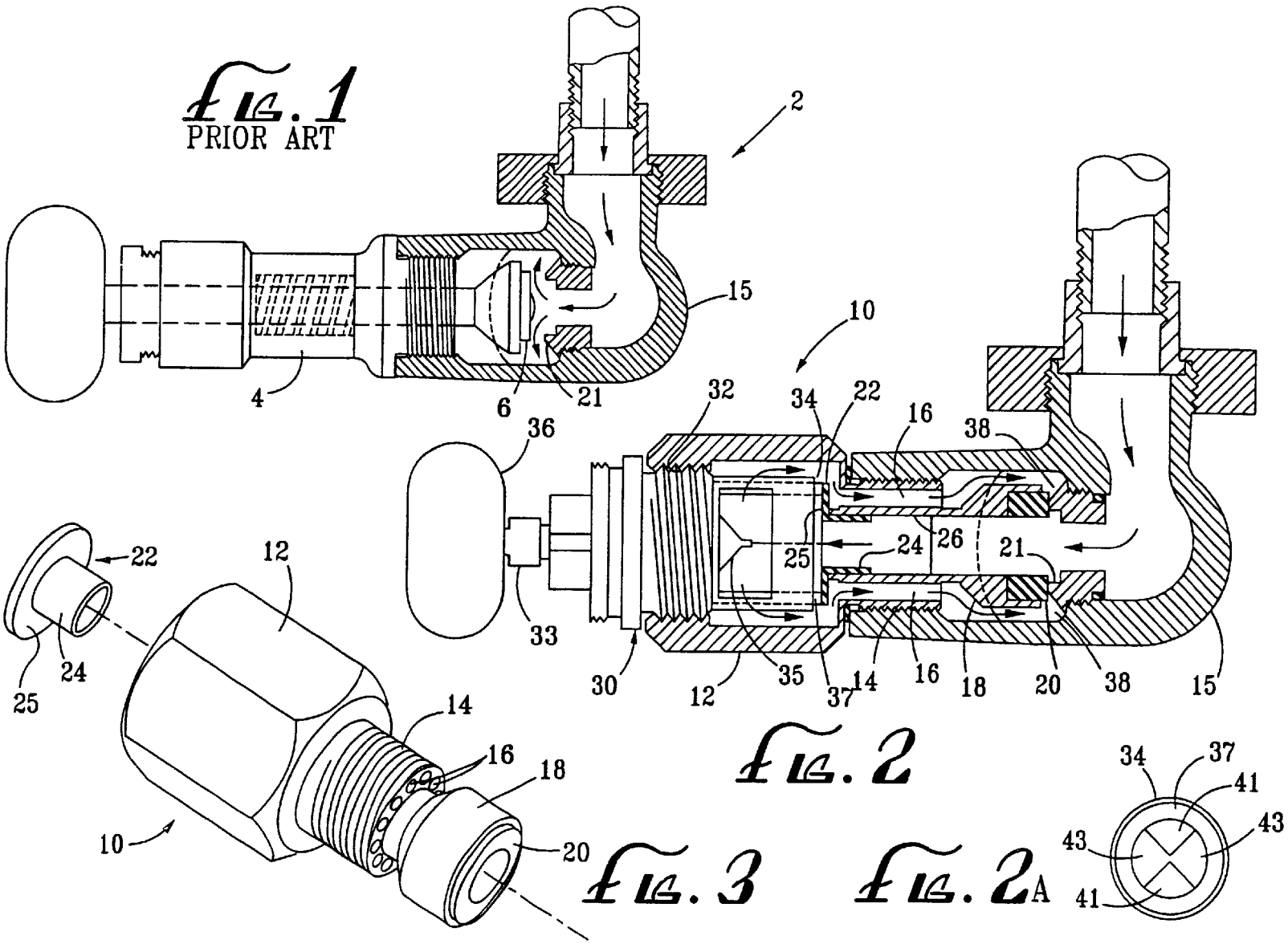
FIG. 1 PRIOR ART
FIG. 1 is an elevational view, partially in section, of a prior art valve device connected with a manifold.
FIG. 2 is a sectional view of an adapter according to the present invention mounted on a conventional water manifold.
FIG. 2A is an elevational view of valve elements utilized with the invention.
FIG. 3 is an exploded perspective view of the adapter of FIG. 2.

Referring to the drawings, a prior art conventional valve and manifold assembly 2 includes a manifold 15 wherein a valve assembly 4 is threadedly mounted in a threaded opening in the manifold, as shown. A resilient seal 6 when urged against seat 21 in the manifold, closes the valve and prevents flow to the manifold interior past the seat, and opening of the valve, as by several rotations of the knob shown, opens the valve to permit flow by the directional arrows. Several rotations of the knob are required to effect proper opening or closing of the valve.

Referring to the drawings, a preferred form of adapter 10 according to the invention is shown in FIGS. 2 and 3 as comprising an enlarged body portion 12 of hexagonal configuration for engagement with a wrench for rotation, a threaded portion 14 integral with the body portion and through which extend a plurality of small passages 16 parallel to a longitudinal axis of the adapter. A sealing portion 18 is integral with threaded portion 14 and body adapter portion 12. Mounted therein is an annular resilient seal 20 for sealing engagement with an annular shoulder or seat 21 of a conventional water supply manifold member 15, as shown. Threaded portion 14 of the adapter is threadedly secured in a threaded opening in a conventional water supply manifold 15 (FIG. 2). A seal 22 has an enlarged annular portion 25 and a reduced tubular portion 24 adapted to fit within a tubular passage 26 in the adapter, as shown in FIG. 2.

An assembly comprising the knob 36 and a valve cartridge 34 is threadedly mounted in a threaded end opening 32 of the adapter (FIG. 2). Referring to FIGS. 2 and 2A, the valve mechanism comprises a valve element 35 mounted at the end of a shaft 33 rotatable by knob 36. A second valve element 37 is fixedly mounted in the cartridge. Each of the valve elements 35, 37 is of circular configuration and defines quarter-circle portions 41, 43 with quarter-circle open spaces therebetween. When valve element 35 is rotated to the position wherein the solid quarter-circle portions of the two valve elements are in registration, the valve is open, and when the valve element 35 is rotated to a position wherein the quarter-circle portions of the valve elements are out of registration, the valve is closed, as will be understood from the geometry of the parts. Opening or closure of the valve is thus effected with only a one-quarter revolution of knob 36.

Such quarter-turn valve cartridges are available from various manufacturers, and were not originated by Applicants. Such quarter-turn valves had not been developed and were not available until fairly recently, and many existing manifolds and valves were manufactured and installed before such valves were available.

With the valve 34 closed, water is blocked from passing in the direction indicated by the arrows and is not passed into or through the valve 34. With the knob 36 rotated to open the valve, water from the manifold 15 flows as shown by the directional arrows in FIG. 2. Thus, it passes inwardly past seal 20 at seat 21, thence into the valve 34, thence through the open valve and via the path indicated, and thence through the plural openings 16 in threaded portion 14, and exits at the passage or opening 38 defined between adapter seal portion 18 and an adjacent portion of manifold 15. The water then passes through the manifold (the path therein not shown), and typically to an output tap on the manifold for use.

Figure 4:
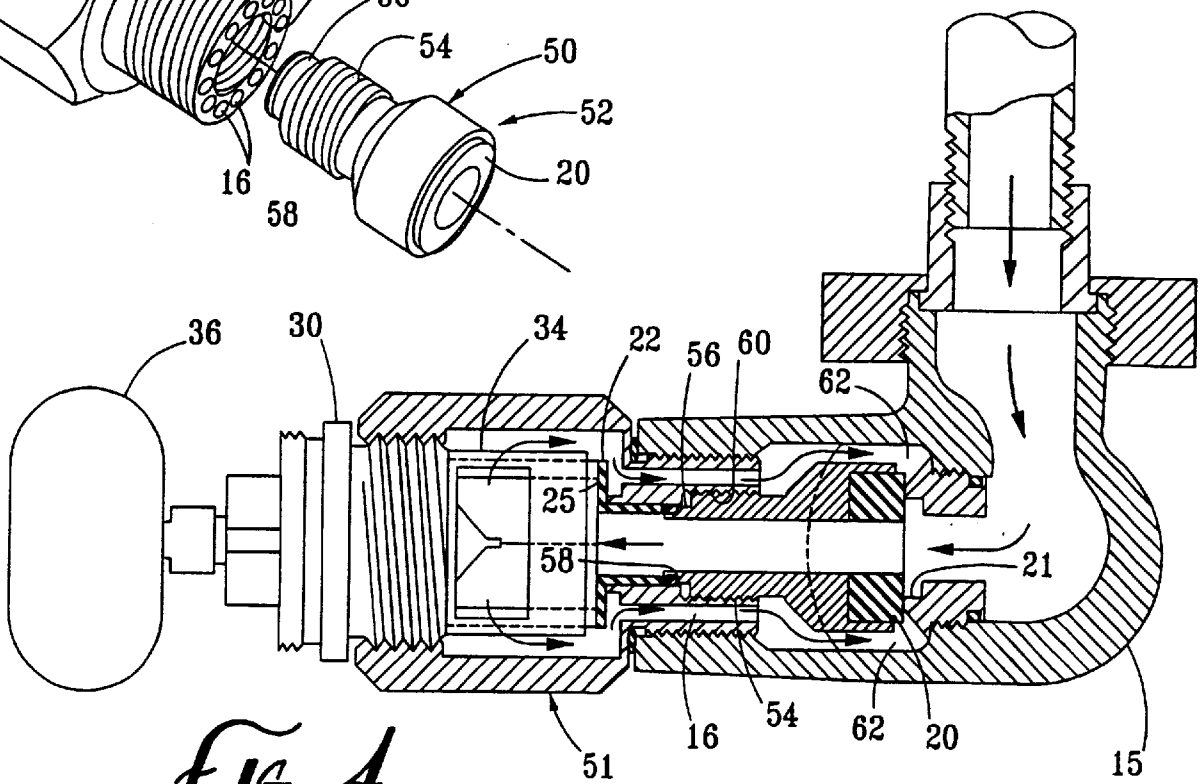
FIG. 4 is a sectional view of a modified form of the invention mounted on a conventional water manifold.
Figure 5:
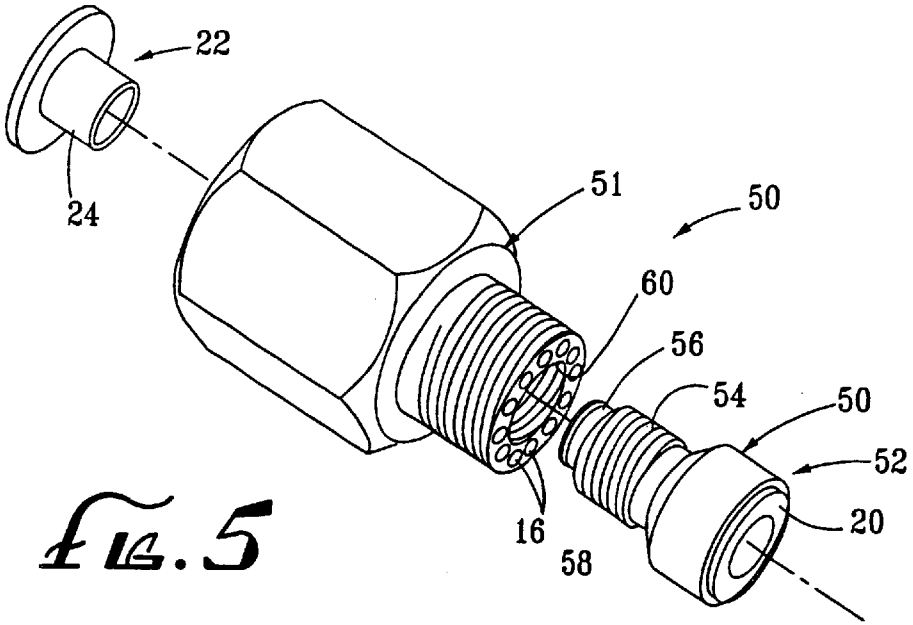
FIG. 5 is an exploded perspective view of the adapter shown in FIG. 4.

FIGS. 4 and 5 illustrate a second embodiment 50 of the adapter of the invention wherein, instead of a threaded portion being integral with a body 51, a sealing member 52 has threaded portion 54 and a reduced end portion 56 having 5 thereon an annular seal 58 in a groove. The threaded portion 54 is received in a threaded bore 60 in the body member 51.

The embodiment of FIGS. 4 and 5 is otherwise similar to the embodiment of FIGS. 2 and 3, and with the valve open, water flow takes a similar path and exits at an opening 62 to the manifold 15.

The adapter of FIGS. 4 and 5 is adapted to compensate for or to accommodate variations in the dimensions of components for manufacturing tolerances, thus to provide accurate axial 15 longitudinal positioning of the adapter cartridge relative to the water manifold. By selective rotation of body member 51, the desired selected positioning of the valve cartridge relative to the annular shoulder or seat 21 of the manifold, is effected.

The adapter of the invention is relatively quickly and easily installed on an existing manifold. Generally, disassembly of existing plumbing hardware is not necessary nor is removal of any wall portion. The replacement of an old 5 valve arrangement with a relatively new cartridge valve, with the adapter according to the present invention, can be accomplished in about fifteen minutes. The prior valve assembly is removed by threaded disengagement, and the adapter of the invention is threadedly mounted in place in the existing old manifold. A typical installation would be in a conventional shower installation, older installations including a valve handle cooperating with a compression seal.

The quarter-turn valve operation utilized with the invention contrasts with older valve installations which typically require multiple turns of a handle or knob to effect opening or closure. Even with considerable wear, the quarter-turn cartridge valve utilized with the invention maintains essentially the same knob positions of rotation for both the open and closing positions of the valve. In contrast, older types of valves, with wear over a period of time, undesirably progressively change the rotational positions of a knob or handle for open and closed valve positions.

It will be understood that various changes and modifications may be made from the preferred embodiments discussed above without departing from the scope of the present invention, which is established by the following claims and equivalents thereof.

The inventors claim:

1. An adapter for installation between a valve and a manifold, comprising:

a body having a passage therethrough with an internally threaded portion for engaging with the valve, an externally threaded adapter portion for engaging with the manifold, the adapter portion having:

an axial passage communicating with the passage of the body for flow of water from the manifold to the valve, a plurality of internal passages communicating with the passage of the body for flow of water from the valve to the manifold, and a seal disposed at the axial passage for engaging with a cartridge of the valve when the valve is closed, and a sealing portion extending from the adapter portion and having a passage for communicating with the manifold, and a resilient seal for engaging with a seat of the manifold.

2. An adapter according to claim 1, wherein the resilient seal is annular.

3. An adapter according to claim 1, the seal of the adapter portion includes an enlarged generally flat annular seal portion adapted to engage the cartridge of the valve and a reduced tubular portion adapted to sealingly engage in passage of the adapter portion.

4. An adapter for coupling a valve to a manifold, the valve having outer threading and a cartridge with an element, the manifold having inner threading and a seat, the adapter comprising:

a body portion including:

inner threading for engaging with the outer threading of the valve; and a through passage for receiving the cartridge when the body portion is engaged with the valve;

an adapter portion connected to the body portion and including:

outer threading for engaging with the inner threading of the manifold;

a plurality of internal passages communicating with the through passage of the body portion;

a through passage communicating with the through passage of the body portion; and a seal disposed at the through passage of the adapter portion for engaging with the element of the valve when the body portion is engaged with the valve and the valve is closed; and a sealing portion extending from the adapter portion and including:

a seal for engaging with the seat of the manifold when the adapter portion is engaged with the manifold; and a through passage communicating with the through passage of the adapter portion;

whereby when the adapter portion is engaged with the manifold:

a seal is formed between the seal of the sealing portion and the seat of the manifold; and water from the manifold is able to flow through the through passage of the sealing portion to the through passage of the adapter portion to the through passage of the body portion; and whereby when the valve is engaged with the body portion and:

when the valve is closed, a seal is formed between the seal and the element of the valve, thereby preventing water from the manifold from flowing from the through passage of the adapter portion to the through passage of the body portion; and when the valve is opened, water from the manifold is able to flow through the through passage of the sealing portion to the through passage of the adapter portion to the through passage of the body portion to the annular passages of the adapter portion.

5. An adapter as claimed in claim 4 wherein the sealing portion is integral with the adapter portion.

6. An adapter as claimed in claim 4 wherein the sealing portion is releasably engageable with the adapter portion.

7. An adapter as claimed in claim 6 wherein adapter portion includes inner threading and the sealing portion includes outer threading for engaging with the threading of the adapter portion.

8. An adapter as claimed in claim 4 wherein annular passages are formed axially through the adapter portion.

9. An adapter as claimed in claim 4 wherein the seal of the adapter portion is a separate element.

10. An adapter for retrofitting a valve to an existing manifold, the valve having outer threading and a cartridge with an element, the manifold having inner threading and a seat, the adapter comprising:

a valve portion including:

an inner threaded portion for engaging with the outer threading of the valve;

a through passage for receiving the cartridge of the valve when the inner threaded portion is engaged with the outer threading of the valve; and a seat for engaging with the element of the valve to form a seal when the inner threaded portion is engaged with the outer threading of the valve and when the valve is closed; and a manifold portion including:

an outer threaded portion for engaging with the inner threading of the manifold;

a through passage communicating with the through passage of the valve portion through the seat such that a through passage is formed axially through the adapter;

a plurality of internal passages communicating with the through passage of the valve portion and with the manifold when the outer threaded portion is engaged with the inner threading of the manifold; and a seal for engaging with the seat of the manifold to form a seal when the outer threaded portion is engaged with the inner threading of the manifold;

wherein when the manifold portion is engaged with the manifold and the valve is engaged with the valve portion:

when the valve is opened, water from the manifold flows through the through passage and through the annular passages back to the manifold; and when the valve is closed, water from the manifold is prevented from flowing through the through passage by the seal formed at the seat of the valve portion.

11. An adapter as claimed in claim 10 wherein the outer threading of the valve is incompatible with the inner threading of the manifold such that the valve is unable to be engaged with the manifold, wherein:

the inner threaded portion of the valve portion is compatible with the outer threading of the valve; and the outer threaded portion of the manifold portion is compatible with the inner threading of the manifold.

12. An adapter as claimed in claim 10 further comprising a resilient seal disposed at the seat of the valve portion for engaging with the element of the cartridge of the valve when the valve is closed.

13. An adapter as claimed in claim 10 wherein the seal of the manifold portion is axially adjustable.

14. An adapter as claimed in claim 10 wherein the manifold portion includes a sealing portion on which the seal is disposed.

15. An adapter as claimed in claim 14 wherein the sealing portion is releasably engageable with the manifold portion.

16. An adapter as claimed in claim 15 wherein the through passage of the manifold portion includes inner threading and the sealing portion includes outer threading for engaging with the inner threading of the through passage of the manifold portion.

17. In combination, a valve and an adapter for coupling to an existing manifold having inner threading and a seat, the combination comprising:

a valve having outer threading and including a cartridge and an element; and an adapter including:

a valve portion having inner threading for engaging with the outer threading of the valve, the valve portion including:

a through passage for receiving the cartridge of the valve when the inner threaded portion is engaged with the outer threading of the valve; and a seat for engaging with the element of the valve to form a seal when the inner threaded portion is engaged with the outer threading of the valve and when the valve is closed; and a manifold portion having outer threading for engaging with the inner threading of the manifold, the manifold portion including:

a through passage communicating with the through passage of the valve portion through the seat such that a through passage is formed axially through the adapter;

a plurality of internal passages communicating with the through passage of the valve portion and with the manifold when the outer threaded portion is engaged with the inner threading of the manifold; and a seal for engaging with the seat of the manifold to form a seal when the outer threaded portion is engaged with the inner threading of the manifold;

wherein when the manifold portion is engaged with the manifold and the valve is engaged with the valve portion:

when the valve is opened, water from the manifold flows through the through passage and through the annular passages back to the manifold; and when the valve is closed, water from the manifold is prevented from flowing through the through passage by the seal formed at the seat of the valve portion.

18. A combination as claimed in claim 17 wherein the valve is a quarter-turn valve.

* * * * *